US005445416A

United States Patent [19]

Zareck

[11] Patent Number: 5,445,416

[45] Date of Patent: Aug. 29, 1995

[54] BOOK HOLDER

[76] Inventor: Mark A. Zareck, 3014 S. Olathe Way, Aurora, Colo. 80013

[21] Appl. No.: 313,802

[22] Filed: Sep. 28, 1994

[51] Int. Cl.[6] ..... B42D 9/00

[52] U.S. Cl. ..... 281/42

[58] Field of Search ..... 281/42, 45; 116/234; 40/352

[56] References Cited

U.S. PATENT DOCUMENTS 606,924 7/1898 Hale ..... 281/42
2,692,780 10/1954 Billings ..... 281/42
4,572,546 2/1986 Morrison ..... 281/42
5,246,251 9/1993 Evans ..... 281/42

*Primary Examiner*—Willmon Fridie

[57] ABSTRACT

A holder for supporting a book or magazine in an open position for reading. The inventive device includes a main support member having a pair of lateral extensions projection therefrom. A pair of arms project from the lateral extensions and each terminate in a flange positioned to engage an edge of the book. A pair of support levers are pivotally mounted to the lateral extensions and engage the cover of the book to bias the book against the flanges.

6 Claims, 3 Drawing Sheets

BOOK HOLDER

BACKGROUND OF THE INVENTION

1. Field of the Invention

The present invention relates to holding devices and more particularly pertains to a book holder for supporting a book or magazine in an open position for reading.

2. Description of the Prior Art

The use of holding devices is known in the prior art. More specifically, holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art holding devices include U.S. Pat. Nos. 5,067,682; 5,069,409; 561,623; 4,645,236; and 5,246,251.

While these devices fulfill their respective, particular objectives and requirements, the aforementioned patents do not disclose a book holder for supporting a book or magazine in an open position for reading which includes a main support member having a pair of lateral extensions projecting therefrom, a pair of arms projecting from the lateral extensions and each terminating in a flange positioned to engage an edge of the book, and a pair of support levers pivotally mounted to the lateral extensions and operable to engage the cover of the book to bias the book against the flanges.

In these respects, the book holder according to the present invention substantially departs from the conventional concepts and designs of the prior art, and in so doing provides an apparatus primarily developed for the purpose of supporting a book or magazine in an open position for reading.

SUMMARY OF THE INVENTION

In view of the foregoing disadvantages inherent in the known types of holding devices now present in the prior art, the present invention provides a new book holder construction wherein the same can be utilized for supporting a book or magazine in an open position for reading. As such, the general purpose of the present invention, which will be described subsequently in greater detail, is to provide a new book holder apparatus and method which has many of the advantages of the holding devices mentioned heretofore and many novel features that result in a book holder which is not anticipated, rendered obvious, suggested, or even implied by any of the prior art holding devices, either alone or in any combination thereof.

To attain this, the present invention generally comprises a holder for supporting a book or magazine in an open position for reading. The inventive device includes a main support member having a pair of lateral extensions projection therefrom. A pair of arms project from the lateral extensions and each terminate in a flange positioned to engage an edge of the book. A pair of support levers are pivotally mounted to the lateral extensions and engage the cover of the book to bias the book against the flanges.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new book holder apparatus and method which has many of the advantages of the holding devices mentioned heretofore and many novel features that result in a book holder which is not anticipated, rendered obvious, suggested, or even implied by any of the prior art holding devices, either alone or in any combination thereof.

It is another object of the present invention to provide a new book holder which may be easily and efficiently manufactured and marketed.

It is a further object of the present invention to provide a new book holder which is of a durable and reliable construction.

An even further object of the present invention is to provide a new book holder which is susceptible of a low cost of manufacture with regard to both materials and labor, and which accordingly is then susceptible of low prices of sale to the consuming public, thereby making such book holders economically available to the buying public.

Still yet another object of the present invention is to provide a new book holder which provides in the apparatuses and methods of the prior art some of the advantages thereof, while simultaneously overcoming some of the disadvantages normally associated therewith.

Still another object of the present invention is to provide a new book holder for supporting a book or magazine in an open position for reading.

Yet another object of the present invention is to provide a new book holder which includes a main support member having a pair of lateral extensions projecting therefrom, a pair of arms projecting from the lateral extensions and each terminating in a flange positioned to engage an edge of the book, and a pair of support levers pivotally mounted to the lateral extensions and operable to engage the cover of the book to bias the book against the flanges.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
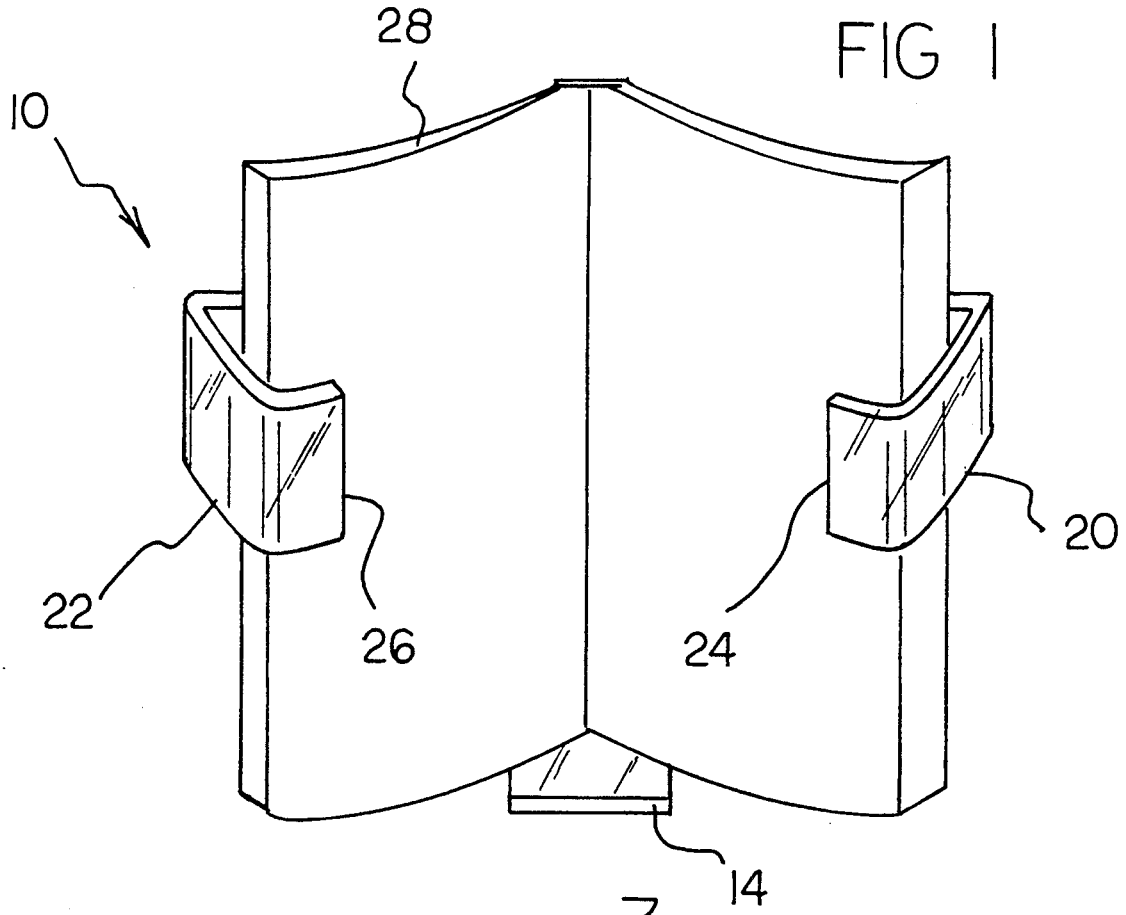
FIG. 1 is a front elevation view of a book holder according to the present invention in use.
Figure 2:
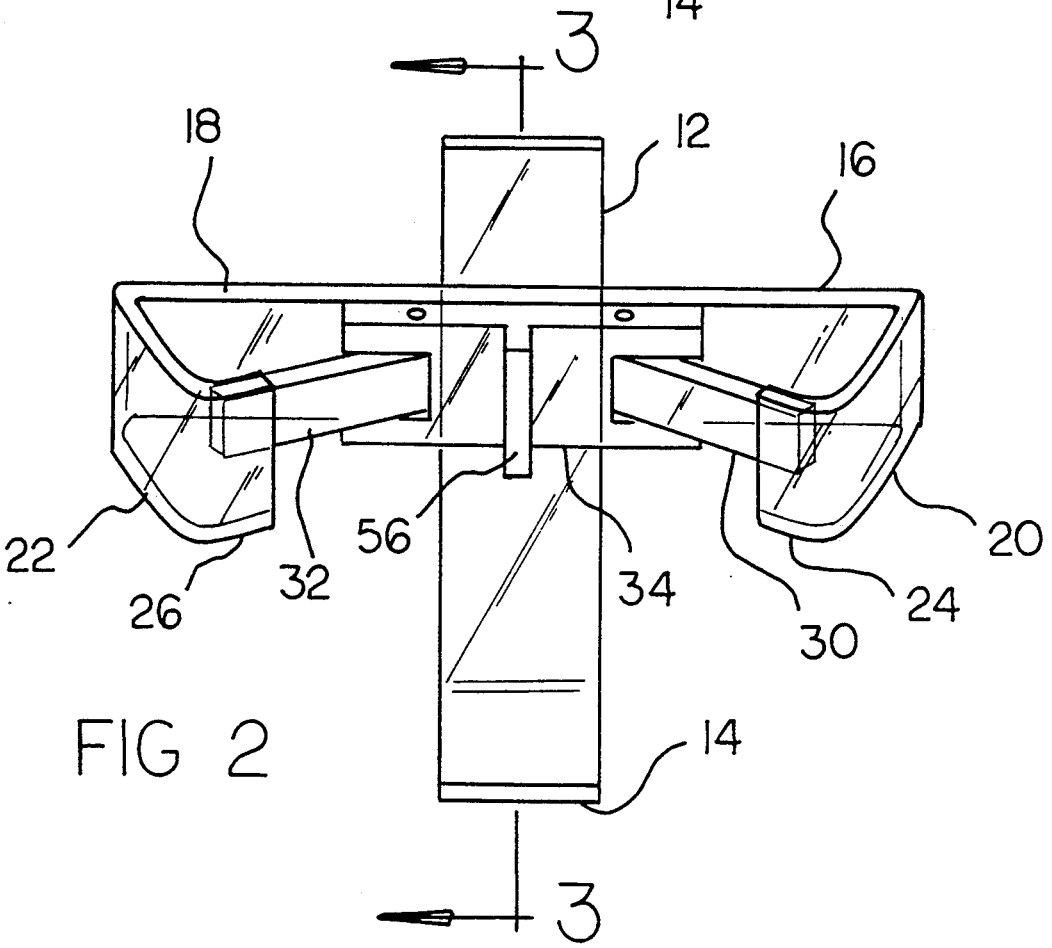
FIG. 2 is a front elevation view of the book holder, per se.
Figure 3:
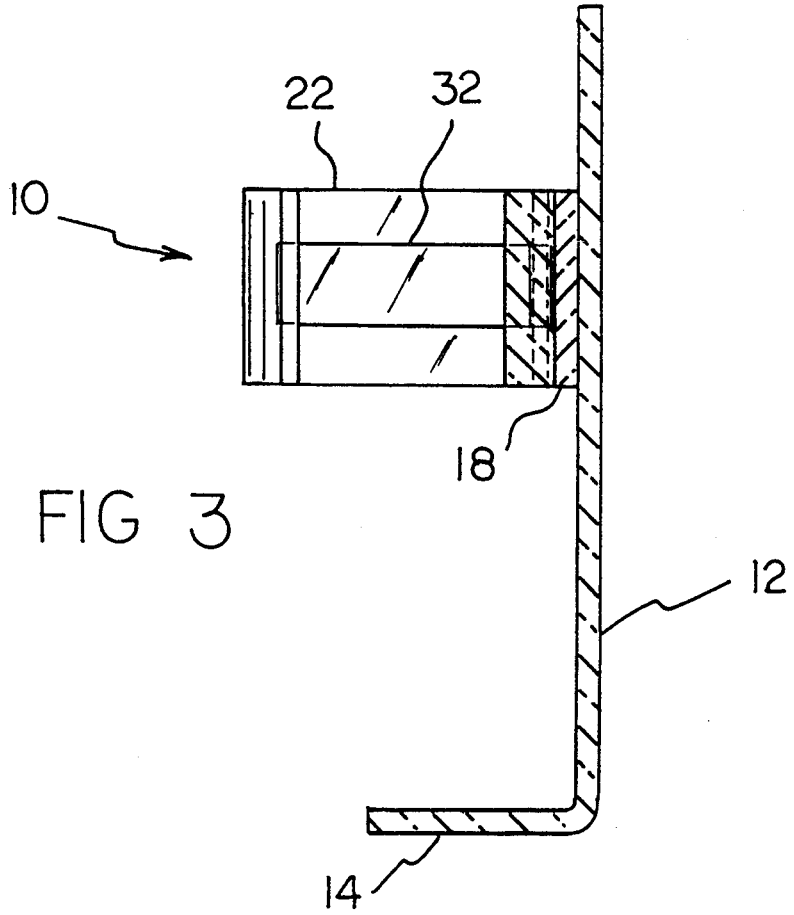
FIG. 3 is a cross-sectional view taken along line 3—3 of FIG. 2.

With reference now to the drawings, and in particular to FIGS. 1–5 thereof, a new book holder embodying the principles and concepts of the present invention and generally designated by the reference numeral 10 will be described.

Figure 4:
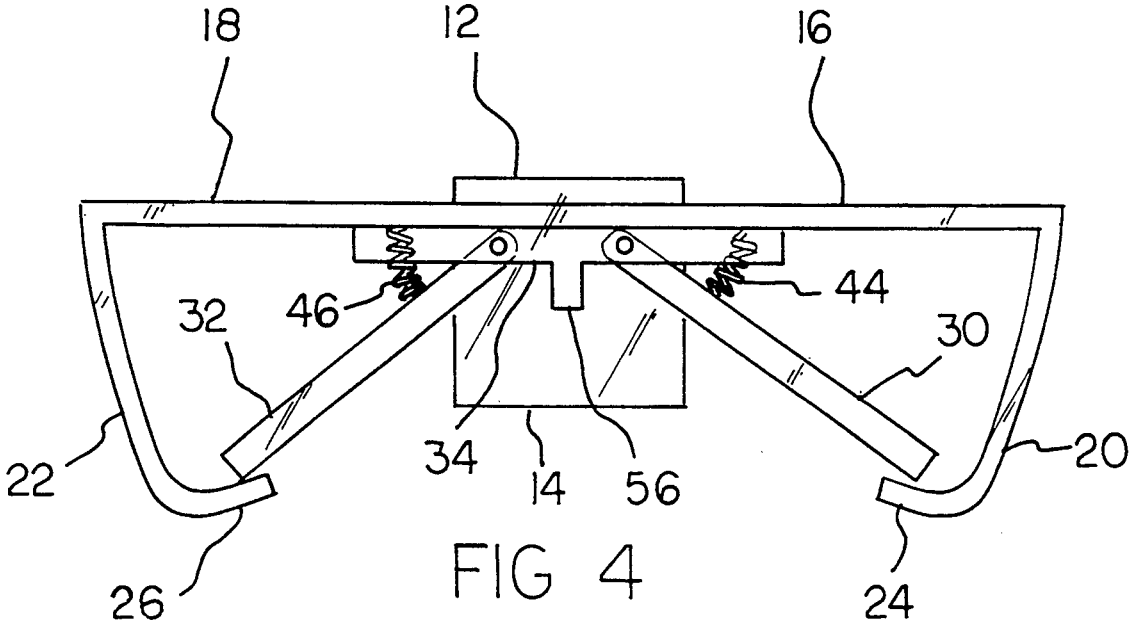
FIG. 4 is a top plan view of the device.

More specifically, it will be noted that the book holder 10 comprises a main support member 12 having an upper end and a lower end, with a foot member 14 projecting from the lower end of the main support member. Preferably, the main support member 12 is substantially rectangular in shape, with the foot 14 being integrally connected thereto. As best illustrated in FIG. 4, a first lateral extension 16 projects from the main support member 12 in a first direction, and a second lateral extension 18 projects from the main support member 12 in a second, opposite direction. Preferably, the lateral extensions 16, 18 are integrally formed as a single unit and secured to a front face of the main support member 12. The lateral extensions 16, 18 each include outer distal ends from which a first arm 20 and a second arm 22 respectively project. The arms 20, 22 continue to extend away from the respective lateral extensions 16, 18 and are bent inward towards one another to define a first flange 24 and a second flange 26, respectively. Again, the first and second lateral extensions 16, 18, the first and second arms 20, 22, and the first and second flanges 24, 26 are preferably integrally formed as a single unit and secured to the main support member by an adhesive or the like. The arms 20, 22 are operable to engage respectively opposed lateral edges of a book 28, such as illustrated in FIG. 1, whereby the first and second flanges 24, 26 cooperate to retain the pages of the book 29 in an open position.

Figure 5:
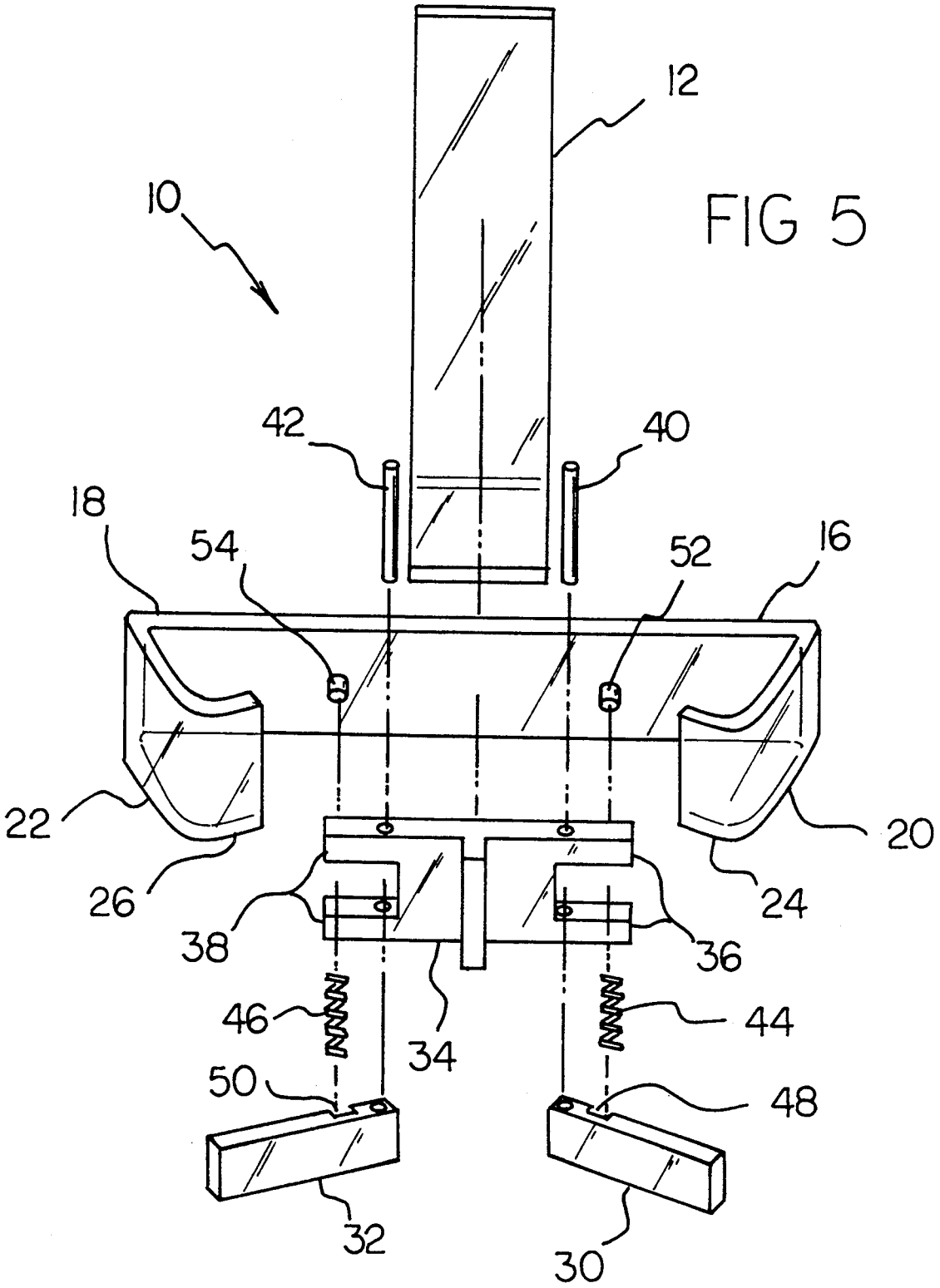
FIG. 5 is an exploded illustration of the book holder.

To bias the pages of the book 28 against the first and second flanges 24, 26, a pair of support levers 30, 32 are pivotally mounted to the lateral extensions 16, 18. To this end, a pivot block 34 is secured to an interior face of the lateral extensions 16, 18, with the pivot block including oppositely extending pairs of spaced projections 36, 38, as best illustrated in FIG. 5. The first support lever 30 is pivotally mounted between the first pair of spaced projections 36 by a pivot pin 40, and the second support lever 32 is pivotally mounted between the second pair of spaced projections 38 by a further pivot pin 42. The support levers 30, 32 are normally biased into contact with the respective first and second flanges 24, 26 by a pair of springs 44, 46. The springs 44, 46 comprise a first coil spring 44 and a second coil spring 46. Each of the springs 44, 46 is engaged to both a respective springs slot 48, 50 formed in the respective support levers 30, 32, and a respective spring mount 52, 54 projecting from the respective first and second lateral extensions 16, 18, as best illustrated in FIG. 5. By this structure, the pages of the book 28 will be biased against the flanges 24, 26 to hold the book in an open position as illustrated in FIG. 1. To turn the pages of the book 28, a user may simply lightly depress the book against the force of either of the spring loaded support levers 30, 32, thereby freeing the pages of the book from contact with the respective flange 24, 26. In addition, the pivot block 34 is preferably provided with an outwardly projecting spine guide 56 which engages the contour formed along the spine of the book 28 when the pages are open to effectively center the book within the device 10.

Preferably, the device is formed of a substantially resilient material which permits outward deformation of the arms 20, 22 to facilitate positioning of the book within the device as illustrated in FIG. 1. Examples of suitable materials include resilient metals and plastics such as acrylic or the like. Preferably, the device is formed of a transparent acrylic plastic which permits reading of the text through the flanges 24, 26 as well as satisfying the material requirements set forth above. Variations in the device include forming the lateral extensions 16, 18 in a telescoping manner which permits the accommodation of different widths of books 28; substituting a torsion spring for the coil springs 44, 46 to bias the support levers 30, 32 against the flanges; providing the main support member 12 with a pivotal mounting to the lateral extension 16, 18 which permits the main support member to be rotated into alignment with the extensions for storage purposes; providing the device 10 with a light unit attached to the main support member 12 for facilitating nighttime reading; and providing the main support member 12 with any of a variety of attaching means or support means which support the device 10 in a desirable position for reading. Such support means may comprise a stand attached to the main support member 12, a bathtub supporting device for supporting the device 10 along a bathtub, a kitchen cabinet supporting device for attaching the book holder to a kitchen cabinet, or a leaning stand pivotally mounted to the main support member 12 so as to support the book holder 10 on top of a horizontal surface at an oblique angle relative thereto for reading.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A book holder comprising:

a main support member having an upper end and a lower end;

a first lateral extension projecting from said main support member in a first direction, said first lateral extension including an outer distal end from which a first arm projects, said first arm extending away from said first lateral extension and bending inward towards said main support member to define a first flange;

a second lateral extension projecting from said main support member in a second direction, said second lateral extension including an outer distal end from which a second arm projects, said second arm extending away from said second lateral extension and bending inward towards said main support member to define a second flange;

support lever means for biasing pages of a book against said first and second flanges.

2. The book holder of claim 1, wherein said support lever means comprises a pair of support levers pivotally mounted to said lateral extensions with spring means biasing said support levers into contact with said flanges.

3. The book holder of claim 2, wherein said support lever means further comprises a pivot block secured to an interior face of said lateral extensions, said pivot block including oppositely extending pairs of spaced projections, with a first one of said pair of support levers being pivotally mounted between a first pair of said spaced projections, and a second one of said pair of support levers being pivotally mounted between a second pair of spaced projections; a first coil spring engaged to both said first lever and said first lateral extension; and a second coil spring engaged to both said second lever and said second lateral extension.

4. The book holder of claim 3, and further comprising a foot member projecting from said lower end of said main support member.

5. The book holder of claim 4, wherein said pivot block is provided with an outwardly projecting spine guide which engages a contour formed along a spine of said book when said pages are open so as to center said book within said book holder.

6. A book holder comprising:

a main support member having an upper end and a lower end;

a foot member projecting from said lower end of said main support member;

a first lateral extension projecting from said main support member in a first direction, said first lateral extension including an outer distal end from which a first arm projects, said first arm extending away from said first laterally extension and bending inward towards said main support member to define a first flange;

a second lateral extension projecting from said main support member in a second direction, said second lateral extension including an outer distal end from which a second arm projects, said second arm extending away from said second lateral extension and bending inward towards said main support member to define a second flange, wherein said first and second lateral extensions, said first and second arms, and said first and second flanges are integrally formed as a single unit; and, support lever means for biasing pages of a book against said first and second flanges, said support lever means comprising a pair of support levers; a pivot block secured to an interior face of said lateral extensions, said pivot block including oppositely extending pairs of spaced projections, with a first one of said pair of support levers being pivotally mounted between a first pair of said spaced projections, and a second one of said pair of support levers being pivotally mounted between a second pair of spaced projections; a first coil spring engaged to both said first lever and said first lateral extension; and a second coil spring engaged to both said second lever and said second lateral extension, said pivot block being provided with an outwardly projecting spine guide which engages a contour formed along a spine of said book when said pages are open so as to center said book within said book holder.

* * * * *